US007782351B2

(12) United States Patent
Kurose et al.

(10) Patent No.: US 7,782,351 B2
(45) Date of Patent: Aug. 24, 2010

(54) EXPOSURE HEAD

(75) Inventors: Mitsukazu Kurose, Nagano-ken (JP); Yujiro Nomura, Nagano-ken (JP); Kiyoshi Tsujino, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 472 days.

(21) Appl. No.: 11/833,140

(22) Filed: Aug. 2, 2007

(65) Prior Publication Data

US 2008/0259153 A1 Oct. 23, 2008

Related U.S. Application Data

(62) Division of application No. 11/195,588, filed on Aug. 1, 2005, now Pat. No. 7,411,601.

(30) Foreign Application Priority Data

Aug. 3, 2004 (JP) ..... 2004-226727
Aug. 3, 2004 (JP) ..... 2004-226731
Aug. 3, 2004 (JP) ..... 2004-226736
Aug. 3, 2004 (JP) ..... 2004-226748

(51) Int. Cl.
*B41J 2/45* (2006.01)

(52) U.S. Cl. ..... 347/238

(58) Field of Classification Search ..... 347/237, 347/238, 247; 257/72
See application file for complete search history.

(56) References Cited

U.S. PATENT DOCUMENTS 4,916,464 A 4/1990 Ito et al.
5,134,340 A 7/1992 Haitz
5,317,344 A 5/1994 Beaman et al.
5,323,084 A 6/1994 Haitz
5,600,363 A 2/1997 Anzaki et al.
5,896,162 A 4/1999 Taniguchi
5,943,586 A 8/1999 Koizumi et al.
6,023,104 A 2/2000 Koizumi et al.
6,194,960 B1 2/2001 Nagumo
6,297,842 B1 10/2001 Koizumi et al.
7,230,271 B2 * 6/2007 Yamazaki et al. ..... 257/72
7,242,416 B2 7/2007 Kurose et al.

(Continued)

FOREIGN PATENT DOCUMENTS

EP 1 420 456 5/2004

(Continued)

*Primary Examiner*—Hai C Pham
(74) *Attorney, Agent, or Firm*—Hogan Lovells US LLP

(57) ABSTRACT

Provided is an exposure head, including: an array substrate having a plurality of organic EL elements arranged in an array on one face; and a plurality of circuit chips having a circuit for driving the organic EL element, and in which the forming face of the circuit is serially arranged along the extending direction of the array substrate so as to face one face of the array substrate; wherein the plurality of circuit chips are mutually serially connected by providing a pair of wiring groups for each mutual boundary location of the circuit chips on one face of the array substrate and outside the arrangement area of the organic EL element, bump-bonding one of the adjacent circuit chips to one end of the pair of wiring groups, and bump-bonding the other adjacent circuit chip to the other end of the pair of wiring groups.

3 Claims, 17 Drawing Sheets

U.S. PATENT DOCUMENTS

| | | | |
|---|---|---|---|
| 7,292,260 | B2 | 11/2007 | Ishibashi et al. |
| 2003/0174199 | A1 | 9/2003 | Inoue et al. |
| 2004/0021761 | A1 | 2/2004 | Gaudiana et al. |
| 2005/0062831 | A1 | 3/2005 | Ishibashi et al. |
| 2005/0140772 | A1 | 6/2005 | Kurose et al. |

FOREIGN PATENT DOCUMENTS

| | | | | |
|---|---|---|---|---|
| JP | 58-078786 | A | | 5/1983 |
| JP | 60-182782 | A | | 9/1985 |
| JP | 61034889 | A | | 2/1986 |
| JP | 63024281 | A | | 2/1988 |
| JP | 63-180249 | U | | 11/1988 |
| JP | 03153372 | A | | 7/1991 |
| JP | 04-31299 | U | | 2/1992 |
| JP | 07-37639 | | | 7/1995 |
| JP | 07-42698 | | | 8/1995 |
| JP | 07-42699 | | | 8/1995 |
| JP | 08-000109 | | | 1/1996 |
| JP | 09-174920 | A | | 7/1997 |
| JP | 09-226171 | | | 9/1997 |
| JP | 09-226172 | | | 9/1997 |
| JP | 10-012377 | A | | 1/1998 |
| JP | 11-320982 | | | 11/1999 |
| JP | 2000-082720 | A | | 3/2000 |
| JP | 2000082720 | A | * | 3/2000 |
| JP | 2000-103111 | A | | 4/2000 |
| JP | 2000-229442 | A | | 8/2000 |
| JP | 2000-289250 | | | 10/2000 |
| JP | 2001-092381 | | | 4/2001 |
| JP | 2002-072907 | | | 3/2002 |
| JP | 2002-216953 | | | 8/2002 |
| JP | 2002-326391 | | | 11/2002 |
| JP | 2003-053951 | | | 2/2003 |
| JP | 2003-084684 | | | 3/2003 |
| JP | 2003-291406 | A | | 10/2003 |
| JP | 2004-095251 | A | | 3/2004 |
| JP | 2004-179641 | | | 6/2004 |
| JP | 2004-179646 | | | 6/2004 |

* cited by examiner 4
9
14a
9
10
10
B
10
10

8
60
70
70
70
70
C 7
7
D
7

60
43
17
40
44
44
44
44
44
33
34
8
59
32
35

EXPOSURE HEAD

CROSS-REFERENCE TO THE RELATED APPLICATIONS

This is a divisional of application Ser. No. 11/195,588 filed Aug. 1, 2005, the entire contents of which are incorporated by reference. This application also claims benefit of priority under 35 USC §119 to Japanese Patent Application Nos. 2004-226727, 2004-226731, 2004226736 and 2004-226748 all filed Aug. 3, 2004, the entire contents of all of which are incorporated by reference.

BACKGROUND

1. Field of the Invention

The present invention relates to an exposure head for forming a latent image with a multi-exposure method on a photoreceptor in an electrophotographic printer or copy machine.

2. Description of the Related Art

In the field of image formation devices, various proposals have been made in adopting an organic EL as the light source for exposing the photoreceptor (for example, c.f. Japanese Patent Laid-Open Publication No. H9-226171).

FIG. 17 is a diagram exemplifying the configuration of an organic EL array print head adopting an organic EL as the light source. As shown in FIG. 17, arranged on a chip-on-board (hereinafter referred to as "COB") substrate 100 are an organic EL array substrate 300 having an organic EL array 200, and a plurality of driver ICs 400 for controlling the emission of each organic EL. The COB substrate 100 and driver IC 400 are electrically connected with a bonding wire 500, and the driver IC 400 and organic EL array substrate 300 are also electrically connected with the bonding wire 500. As described above, as a result of using an organic EL as the light source for exposing the photoreceptor, a single organic EL array substrate 300 can be manufactured collectively, and cost reduction and high densification can be sought in comparison to conventional mounting methods of arranging a plurality of LED chips on a straight line.

Nevertheless, when the organic EL array substrate and plurality of driver ICs are arranged planarly on the COB substrate as described above, there is an inconvenience in that the mounting area will increase, and the COB substrate will become enlarged. Further, a wire bonding process will be required for electrically connecting the organic EL array substrate and the respective driver ICs, and there is an inconvenience in that the wiring between the respective terminals to be wire-bonded to the respective organic EL light emitting units in the organic EL substrate will become complicated and complex. Such inconveniences are especially noticeable when arranging a plurality of rows of organic EL light emitting units against the vertical scanning direction and performing multi-exposure thereto.

SUMMARY

An object of the present invention is to provide an exposure head capable of curtailing the mounting area.

The first mode of the present invention is an exposure head used for forming a latent image on a photoreceptor in a printer, including: an array substrate having a plurality of organic EL elements arranged in an array on one face, and configured such that an outgoing beam from the organic EL elements is emitted to the other face; and a plurality of circuit chips having a circuit for driving the organic EL element, and in which the forming face of the circuit is serially arranged along the extending direction of the array substrate so as to face one face of the array substrate; wherein the plurality of circuit chips are mutually daisy-chain connected by providing a pair of wiring groups for each mutual boundary location of the circuit chips on one face of the array substrate and outside the arrangement area of the organic EL element, bump-bonding one of the adjacent circuit chips to one end of the pair of wiring groups, and bump-bonding the other adjacent circuit chip to the other end of the pair of wiring groups.

According to the foregoing configuration, the respective organic EL light emitting units and the driver IC can be electrically connected without having to use wire bonding, and the mounting area can be curtailed thereby. Further, by adopting the configuration where a wiring group is provided on one face of the array substrate, and connecting the circuit chips with such wiring group, a wiring board for connecting the circuit chips will no longer be required, the number of components can be reduced, and the mounting area can be further curtailed as a result thereof.

Preferably, the circuit chip has an internal wiring group configuring a signal path together with the pair of wiring groups, and the internal wiring group is configured from a laminated wiring of two or more layers. In other words, the pair of wiring groups and the internal wiring group built in the circuit chip as a whole will constitute the signal line and power source line.

As described above, by drawing a part of the signal line or the like into the circuit chip and making it pass through such circuit chip, even when it is necessary to cross the signal line midway, this crossing portion can be realized with the multi-layer interconnection in the circuit chip. Thus, the wiring group formed on one face of the array substrate can be made to be a single layer wiring without crossing, and the formation of the wiring group will become easier.

The second mode of the present invention is an exposure head used for forming a latent image on a photoreceptor in a printer, including: an array substrate having a plurality of organic EL elements arranged in an array on one face, and configured such that an outgoing beam from the organic EL element is emitted to the other face; and a plurality of circuit chips having a drive circuit of the organic EL element, and in which the forming face of the drive circuit is serially arranged along the longitudinal direction of the array substrate so as to face one face of the array substrate; wherein a plurality of array substrate side electrode pads provided to the array substrate so as to come in contact with each of a plurality of bumps and a plurality of circuit chip side electrode pads provided respectively to the plurality of circuit chips so as to come in contact with each of the plurality of bumps are respectively arranged in a zigzag shape along the longitudinal direction of the array substrate.

According to the foregoing configuration, the respective organic EL light emitting units and the circuit chip can be electrically connected without having to use wire bonding, and the mounting area can be curtailed thereby. In particular, by arranging the respective electrode pads in a zigzag shape, for instance, since the mounting area can be curtailed in comparison to the case of arranging the respective electrode pads at even intervals in a two-dimensional array, the width of the overall exposure head (length of the direction orthogonal to the longitudinal direction) can be reduced.

Preferably, with the array substrate, the plurality of organic EL elements are formed in an approximate central area along the longitudinal direction of the array substrate, and the plurality of array substrate side electrode pads are formed at the periphery of the area; with each of the plurality of circuit chips, the drive circuit is formed in an approximate central area along the longitudinal direction of the array substrate, and the plurality of circuit chip side electrode pads are formed at the periphery of the area; and the array substrate and the plurality of circuit chips are respectively arranged such that the drive circuit faces immediately above the plurality of organic EL elements.

As a result of adopting the foregoing configuration, it will be possible to avoid inconveniences such as damages to the drive circuit and/or organic EL element resulting from the stress caused by the suppressing strength during the bump-bonding of the array substrate and circuit chip.

The third mode of the present invention is an exposure head used for forming a latent image on a photoreceptor in a printer, including: an organic EL array substrate in which a plurality of organic EL elements are arranged in an array; a driver IC group having a plurality of driver ICs having formed thereon a circuit for driving the organic EL element, and in which each driver IC is serially arranged along the extending direction of the organic EL array substrate; and a plurality of bumps for electrically connecting the organic EL array substrate and each of the driver ICs; wherein an element forming face having formed thereon a plurality of organic EL elements in the organic EL array substrate and a circuit forming face having formed therein each of the driver ICs in the driver IC group are arranged facing each other via the plurality of bumps.

According to the foregoing configuration, an element forming face in an organic EL array substrate having formed thereon a plurality of organic EL elements and a circuit forming face in a driver IC group having formed therein each of the driver ICs are arranged facing each other via the plurality of bumps. As described above, by using the organic EL array substrate as one sealing means on the side of the light emitting unit, and using the driver IC as the other sealing means, miniaturization is realized with high density mounting, and the mounting area can be reduced thereby. Further, since it is not necessary to provide a sealant separately, the number of components can be reduced, and an exposure head can be manufactured at a low cost.

Preferably, a sealant is disposed at the periphery of the bonded part of the organic EL array substrate and each of the driver ICs bonded with the plurality of bumps.

Preferably, a desiccant is inserted in the gap formed on the inside of the bonded part of the organic EL array substrate and each of the driver ICs.

Preferably, a positioning pad for the bonding is formed respectively to the organic EL array substrate and each of the driver ICs. Preferably, [the exposure head] further includes a condenser lens array substrate provided in correspondence to each of the organic EL elements, and in which a plurality of condenser lenses for condensing the light emitted from each organic EL element are arranged thereon; wherein the condenser lens array substrate is fixed to a non-element forming face in which an organic EL element in the organic EL array substrate is not formed thereon.

The fourth mode of the present invention is an exposure head, including: a glass substrate; a plurality of anode electrodes provided to one face of the glass substrate and formed from a first conductive material; a cathode electrode arranged facing the plurality of anode electrodes and formed from a second conductive material; a first electrode formed from the first conductive material and provided between glass substrate and the cathode electrode at the periphery of the plurality of anode electrodes; a plurality of organic EL emission layers respectively provided between the plurality of anode electrodes and the cathode electrode; and a driver IC having a plurality of drive electrodes arranged facing the one face, and for controlling the emission of the plurality of organic EL emission layers; wherein the cathode electrode is connected to the plurality of organic EL emission layers and the first electrode, and further connected to a drive electrode of the driver IC via a conductive member at the periphery.

According to the foregoing configuration, a plurality of anode electrodes are arranged between the organic EL element and glass substrate in correspondence with the plurality of organic EL elements. Further, the plurality of organic EL elements will share the cathode electrode. In other words, after forming a plurality of anode electrodes and a plurality of organic EL emission layers on the glass substrate, the cathode electrode can be formed such that it can be shared by the organic EL emission layer. The mounting area can be curtailed thereby. Moreover, according to the foregoing configuration, the burden on the organic EL emission layer will be extremely small, and an exposure head with a long emission lifetime can be provided. In addition, according to the foregoing configuration, the anode electrode will be bonded to the driver IC via an electrode and conductive member formed from a material that is the same as the cathode electrode provided at the periphery where the organic EL emission layer is provided. Therefore, according to the foregoing configuration, the burden on the organic EL element caused by the pressure upon bonding will be extremely small, and an exposure head in which the adhesiveness between the member provided on the glass substrate and the driver IC is favorable can be provided.

Preferably, the exposure head further includes a second electrode formed from the second conductive material, and provided on the anode electrode at the periphery of the cathode electrode; wherein the anode electrode is connected to a drive electrode of the driver IC via the second electrode and a conductive member.

As described above, by bonding the anode electrode to a conductive member via the second electrode, an easy-to-manufacture exposure head with more favorable adhesiveness can be provided.

Preferably, the adhesiveness against the glass substrate of the first conductive material is greater than that of the second conductive material.

As described above, by providing the cathode electrode to the glass substrate via a material having greater adhesiveness against the glass substrate in comparison to the cathode electrode, an easy-to-manufacture exposure head with more favorable adhesiveness can be provided.

DETAILED DESCRIPTION

Embodiments pertaining to the present invention are now explained with reference to the drawings.

Figure 1A:
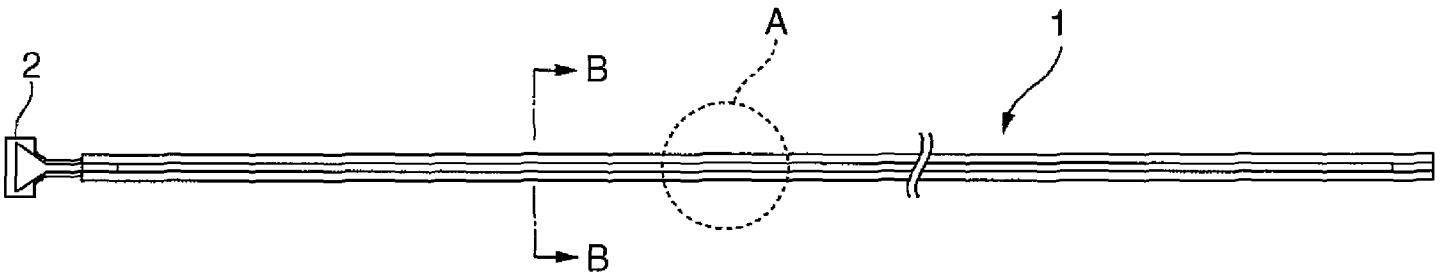
FIG. 1(A) and FIG. 1(B) are schematic diagrams for explaining the overall configuration of the organic EL array exposure head.
Figure 1B:
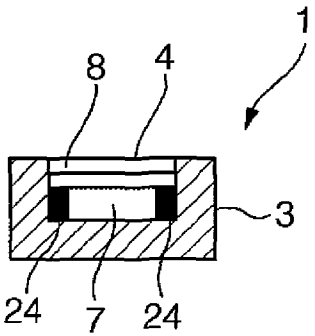

FIG. 1 is a schematic diagram for explaining the overall configuration of an organic EL array exposure head 1. FIG. 1(A) is a plan view (top view), and FIG. 1(B) is a cross section of line B-B illustrated in FIG. 1(A). The organic EL array exposure head 1 of the present embodiment is formed such that the overall length thereof is slightly longer than the printing width of the main scanning direction. Further, since the cross section size of the organic EL array exposure head 1 is extremely small, in FIG. 1, the scale size is changed somewhat in comparison to the actual scale to make the configuration clearly understandable. Details regarding the respective components will be explained with reference to the enlarged diagrams in due order.

As shown in FIG. 1, the organic EL array exposure head 1 of the present embodiment is used for forming a latent image with a multi-exposure method on a photoreceptor in an electrophotographic printer (or copy machine, etc.), and is configured by including, as its constituent elements, a connector 2, a frame 3, a condenser lens array 4, a driver IC 7 and an organic EL array 8. Incidentally, reference numeral 24 represents a sealant.

The connector 2 is to be mutually connected to a printer controller (not shown) on the printer side, and includes a control signal line as a wiring for receiving print data, and a power source line as a wiring for supplying power.

The organic EL array (array substrate) 8 is configured by a plurality of organic EL light emitting units (organic EL elements) being formed in an array on one face of a glass board material. This organic EL array 8 is constituted such that an outgoing beam from the respective organic EL elements is emitted to the other face of the glass substrate via the glass board material (glass substrate).

The driver IC (circuit chip) 7 is for controlling the respective organic EL light emitting units (hereinafter abbreviated as "light emitting units"), and a prescribed number of driver ICs 7 is mounted on the other face of the glass board material of the organic EL array 8. Specifically, the driver ICs 7 are serially arranged along the extending direction of the organic EL array 8 such that the circuit forming face faces one face of the organic EL array 8.

The condenser lens array (condenser lens array substrate) 4 has a plurality of condenser lenses provided in correspondence with each of the light emitting units, and each lens is configured to be arranged roughly immediately above each light emitting unit of the organic EL array 8. According to the foregoing configuration, the respective lights output from each light emitting unit will be condensed with each of the corresponding condenser lenses.

Figure 2:
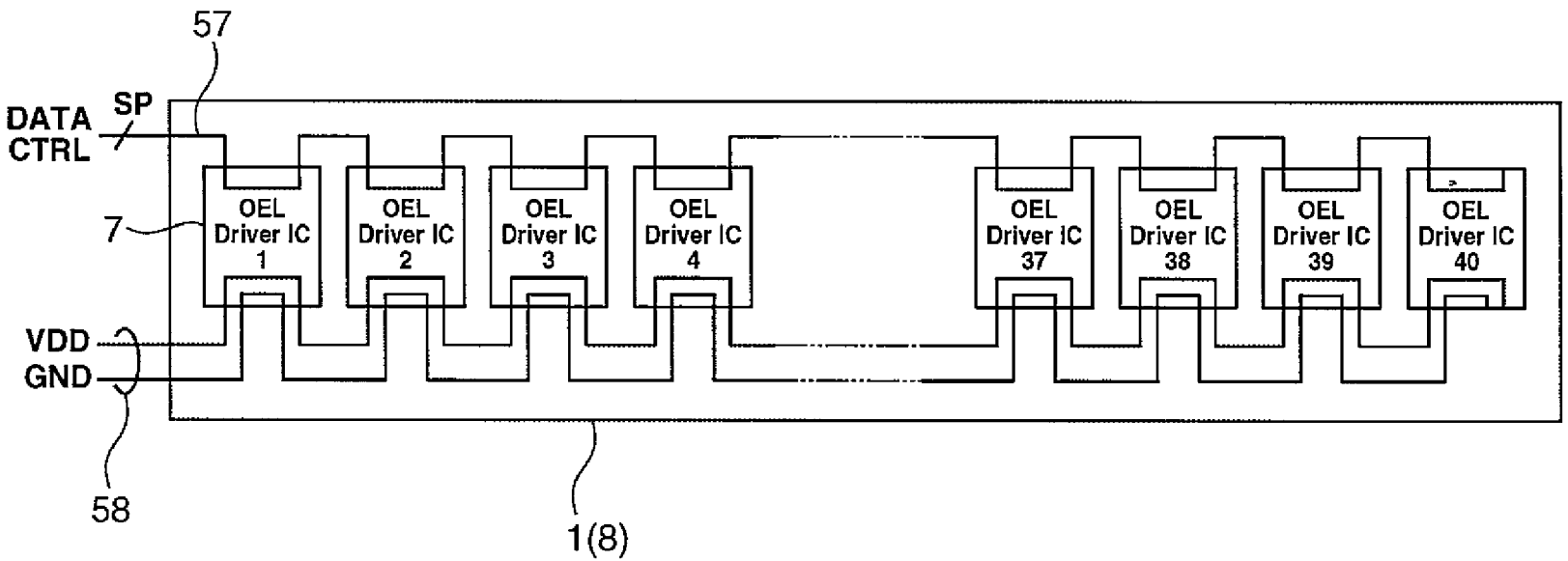
FIG. 2 is a block diagram for explaining the configuration of a control circuit of the organic EL array exposure head.

FIG. 2 is a block diagram for explaining the configuration of a control circuit of the organic EL array exposure head of the present embodiment. As shown in FIG. 2, with the organic EL array exposure head 1, a prescribed number of driver ICs 7 is mounted on the other face of the organic EL array 8 along the main scanning direction. And, each driver IC 7 is configured to control/drive one block worth the number of pixels in the main scanning direction and the organic EL arrays arranged in a zigzag shape in the vertical scanning direction respectively allocated thereto. The driver IC 7 of the present embodiment includes a control circuit and a drive circuit.

A data control line (signal line) 57 is a signal line for daisy-chain connecting a prescribed number of driver ICs 7 in the main scanning direction, and feeding the print data sent from the printer controller to the driver IC 7 allocated per line.

A power source line 58 is used for supplying power to the respective driver ICs 7. The data control line 57 and power source line 58, as shown in FIG. 2, are both daisy-chain connected to the driver IC 7, and the data control line 57 and power source line 58 are also wired inside the driver IC 7 as illustrated in FIG. 2, and patterning can be easily performed without crossing the wiring on one face on the glass board material. The data control line 57 and power source line 58 deposit a conducting layer such as ITO on the glass board material, and are formed via patterning. Incidentally, aluminum or gold plating may be performed in order to lower the wiring resistance.

Figures 3A, 3B, 3C:
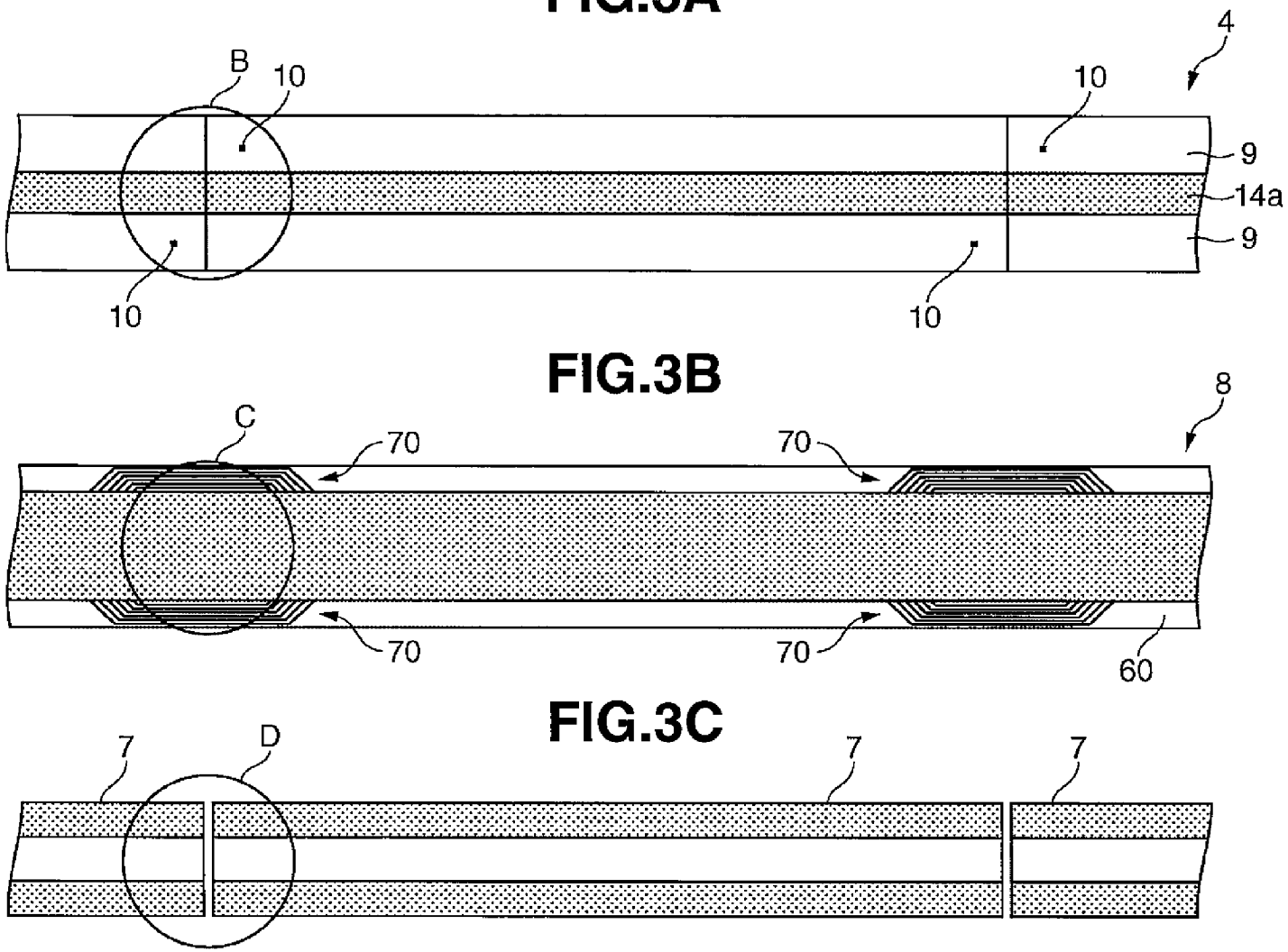
FIG. 3(A) to FIG. 3(C) are plan views for schematically explaining the configuration of components upon enlarging section A illustrated in FIG. 1 of the organic EL array exposure head.

FIG. 3 is a plan view for schematically explaining the configuration of components upon enlarging section A illustrated in FIG. 1 of the organic EL array exposure head 1. As shown in FIG. 3(A), the condenser lens array 4 is arranged immediately above the organic EL array 8, and is formed from a condenser lens group 14*a* for condensing the light output from the respective organic EL elements, and a light shielding material 9 for shielding the light leaking from the light emitting element at the periphery of the organic EL element. The condenser lens array 4 is provided with a positioning pad 10 for the positioning upon being assembled with the organic EL array 8. As shown in FIG. 3(B), the organic EL array 8 is configured by the number of pixels in the main scanning direction of the organic EL array exposure head 1 and a plurality of lines of organic EL elements arranged in a zigzag shape in the vertical scanning direction being formed in an array on the glass board material 60. As shown in FIG. 3(C), each driver IC 7 is mounted in a row along the extending direction of the organic EL array 8. A driver IC group is formed by each of these driver ICs being serially connected with a wiring film (not shown).

Here, as shown in FIG. 3(B) and FIG. 3(C), in the present embodiment, a wiring group 70 associated with the mutual boundary location of the driver ICs 7 is provided on one face of the organic EL array 8 and outside the arrangement area of the organic EL element. In the illustrated example, in each boundary location, a pair of wiring groups 70 is respectively formed in the longitudinal direction of each driver IC 7. Although the details will be described later, one of the adjacent driver ICs 7 is bump-bonded to one end of the wiring group 70, and the other adjacent driver IC 7 is bump-bonded to the other end of the wiring group 70. In other words, in this example, a pair of wiring groups 70 is provided respectively to two adjacent driver ICs 7 at both ends in the longitudinal direction thereof, and one of these wiring groups 70 configures the data control line 57 (i.e., signal path) together with the internal wiring group built in the driver IC 7, and the other [wiring group 70] configures the power source line 58 (i.e., signal path) together with the internal wiring group built in the driver IC 7.

By adopting the foregoing configuration, the respective organic EL light emitting units and the driver IC can be electrically connected without using wire bonding, and the mounting area can be curtailed thereby. Further, by adopting the configuration of providing a wiring group on one face of the array substrate, and connecting the circuit chips with such wiring group, a wiring board for connecting the circuit chips will no longer be required, the number of components can be reduced, and the mounting area can be further curtailed as a result thereof.

Figure 4:
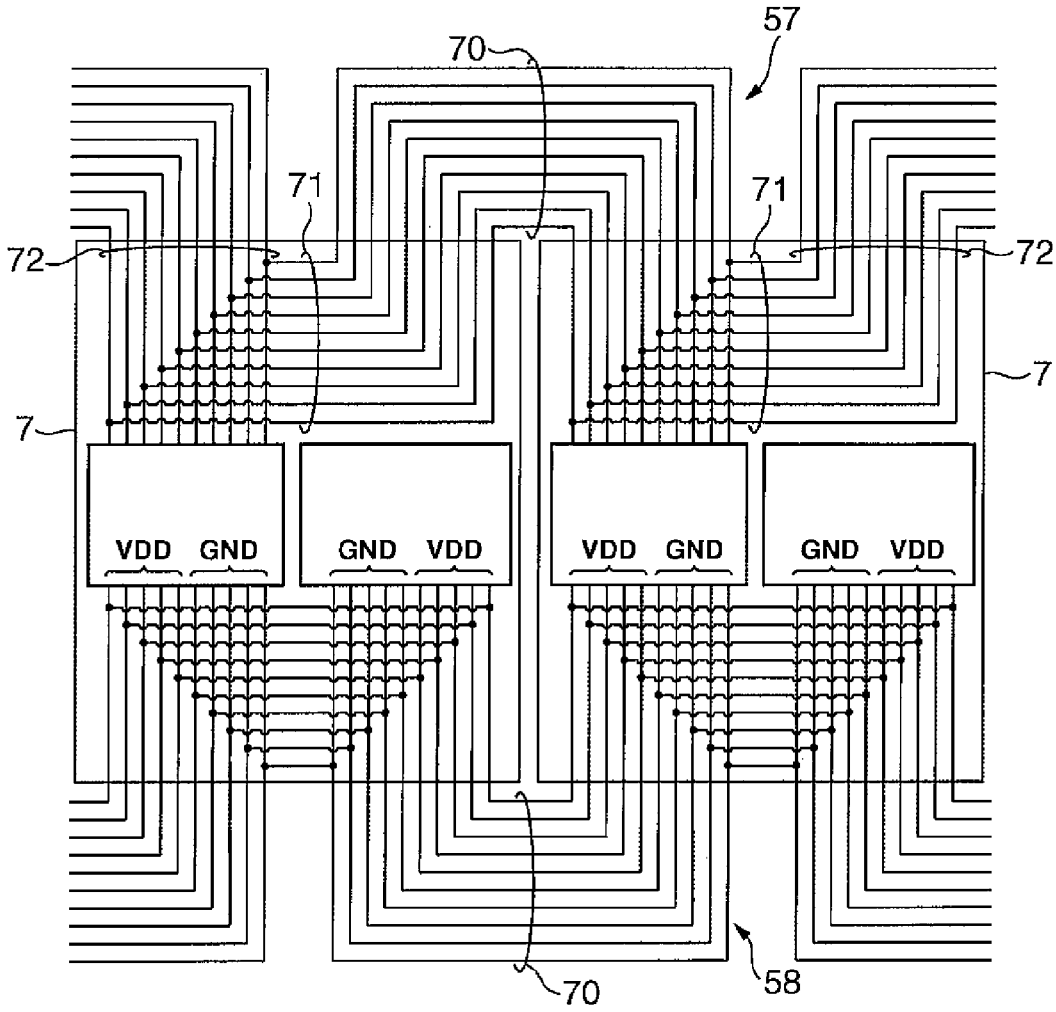
FIG. 4 is a diagram for explaining the detailed configuration of a data control line and power source line.

FIG. 4 is a diagram for explaining the detailed configuration of the data control line 57 and power source line 58. FIG. 4 explains the wiring status upon focusing on the area between the two adjacent driver ICs 7. As described above, on one face of the glass board material 60 of the is organic EL array 8, each wiring group 70 is a parallel connection that repeats IN (input) and OUT (output) at both ends of the driver IC 7 without crossing. And, the portion of the cross wiring that arises upon daisy-chain connecting a plurality of driver ICs 7 is realized by utilizing the laminated wiring built in the driver IC 7 as a result of drawing in the wiring inside the respective driver ICs 7. In other words, in this illustrated example, a two-layer wiring composed of internal wiring groups 71 and 72 is included inside each driver IC 7, a signal path (data control line or power source line) is configured from the multilayer interconnection composed of these internal wiring groups 71, 72 and the foregoing wiring group 70, and a plurality of driver ICs 7 are daisy-chain connected thereby.

As shown in FIG. 4, the power source line 58 is formed from a power supply voltage line VDD and a ground line GND, and configured from five power supply voltage lines VDD and five ground lines GND. Incidentally, the power supply voltage line VDD may supply a plurality of voltages such as the organic EL array drive voltage and so on. And, on the glass board material 60, these wirings; that is, the respective power supply voltage lines VDD and ground lines GND, are provided without crossing each other. Further, the data control line 57 constitutes five LVDS (Low Voltage Differential Signal) lines, and is composed of five types of signal lines. In this example, these five pairs; that is, a total of ten signal lines, are drawn in parallel on the glass board material 60 without crossing each other, and connected to a timing controller, which is an internal module, of the driver IC 7 via the internal wiring groups 71, 72 of the driver IC 7. Incidentally, as described above, although the data control line 57 is configured from the wiring group 70 formed on the glass board material 60 and the internal wiring groups 71, 72 built in the driver IC 7, it is of an isometric wiring as a whole, and is subject to impedance matching.

As described above, by drawing a part of the signal line or the like into the circuit chip and making it pass through such circuit chip, even when it is necessary to cross such signal line midway, this crossing portion can be realized with the multilayer interconnection in the circuit chip. Thus, the wiring group formed on one face of the array substrate can be made to be a single layer wiring without crossing, and the formation of the wiring group will become easier.

Figure 5:
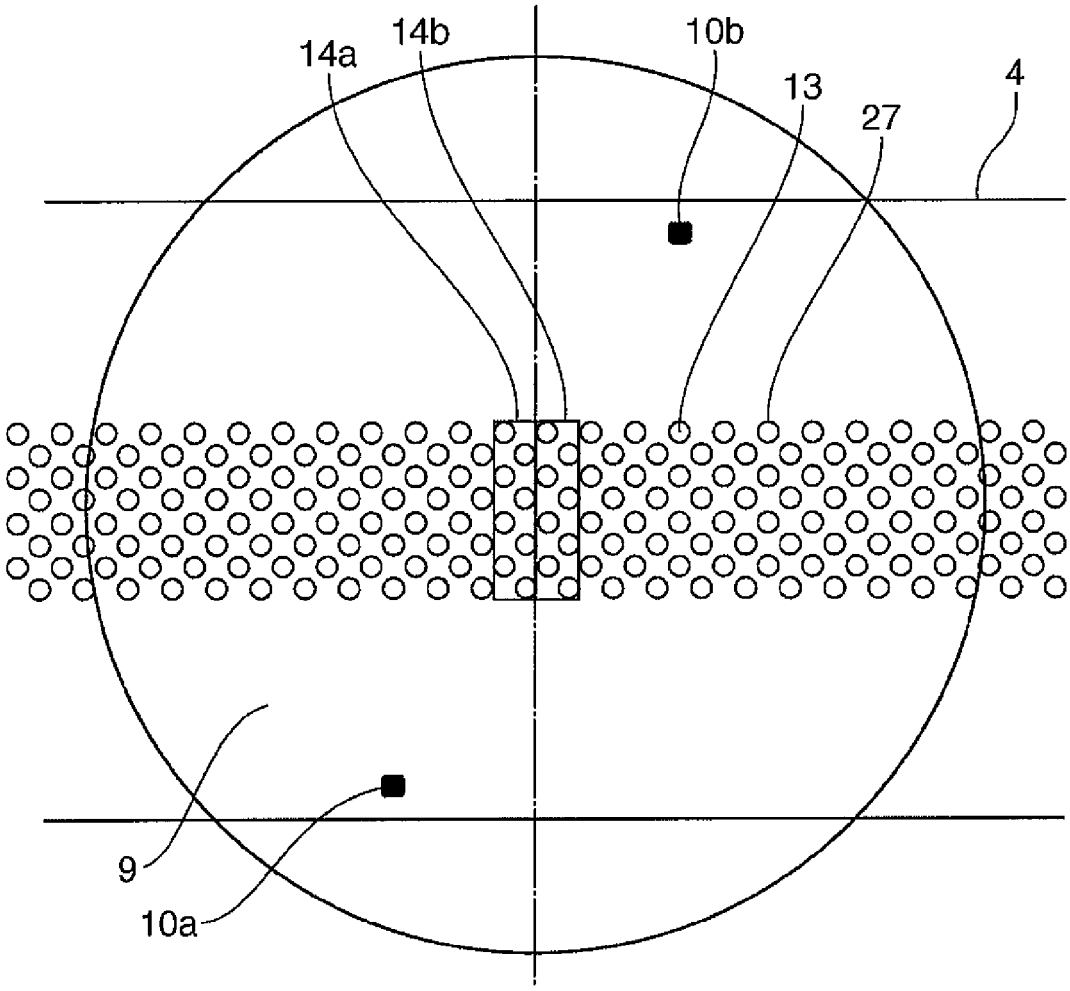
FIG. 5 is an enlarged view of section B illustrated in FIG. 3 of the organic EL array exposure head for showing the detailed configuration of a condenser lens array.

FIG. 5 is an enlarged view of section B illustrated in FIG. 3 of the organic EL array exposure head 1 for showing the detailed configuration of the condenser lens array 4. The condenser lens array 4 is provided with positioning pads (condenser lens assembly side targets) 10*a*, 10*b* for positioning upon bonding with the organic EL array 8.

Further, a light shielding material 9 is provided to one face of the condenser lens array. Moreover, the condenser lens array 4 has a condenser lens 13 corresponding to the number of pixels in the main scanning direction and the plurality of lines arranged in a zigzag shape in the vertical scanning direction, and each condenser lens 13 is embedded in a light guiding hole 27.

Further, a condenser lens similar to the foregoing condenser lens 13 is also provided to the boundary area of the respective driver ICs 7. Specifically, a condenser lens group 14*a* is to be positioned immediately above the organic EL element to be driven with the driver IC 7 (not shown) arranged at the left side of the boundary illustrated with a dashed line in FIG. 5. Similarly, a condenser lens group 14*b* is to be positioned immediately above the organic EL element to be driven with the driver IC 7 (not shown) arranged on the right side of the boundary illustrated with a dashed line in FIG. 5. Incidentally, the detailed configuration of the condenser lens array 4 will be described later.

Figure 6:
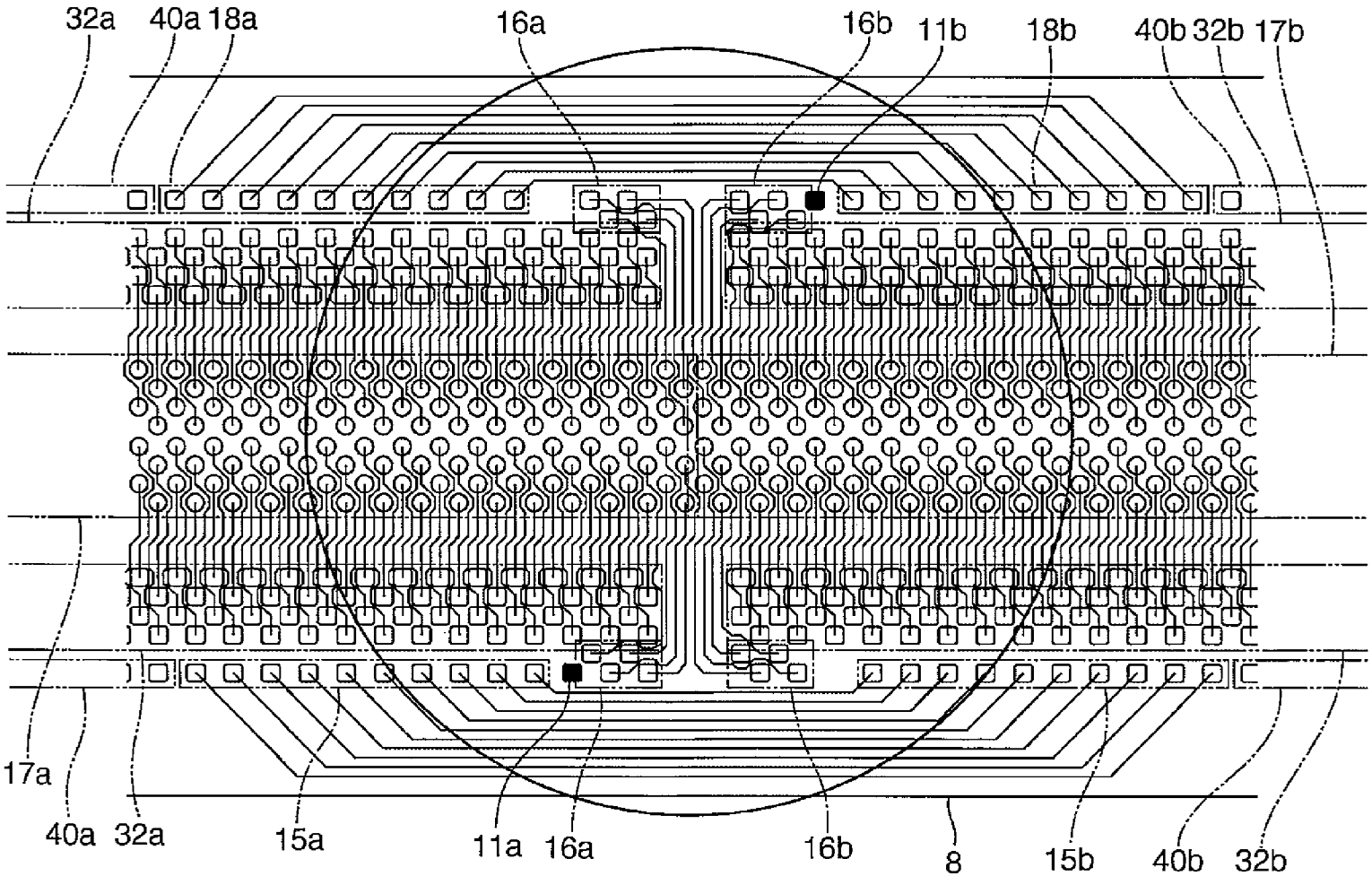
FIG. 6 is an enlarged view of section C illustrated in FIG. 3 of the organic EL array exposure head for showing the detailed configuration of an organic EL array.

FIG. 6 is an enlarged view of section C illustrated in FIG. 3 of the organic EL array exposure head 1 for showing the detailed configuration of an organic EL array 8.

A positioning pad 11*a* is prepared in correspondence with the driver IC 7 to be mounted on the left side of FIG. 6, and a positioning pad 11*b* is prepared in correspondence with the driver IC 7 to be mounted on the right side of FIG. 6.

A power source pad 15*a* is a power source pad on the glass board material 60 side and assumes the connection with the driver IC 7 to be mounted on the left side, and a power source pad 15*b* assumes the connection with the driver IC 7 to be mounted on the right side. In this illustrated example, there are ten pairs of such power source pads which are allocated to the power source potential side (VDD) and ground side (GND), and are connected to the power source line pad of a prescribed number of driver ICs 7 in the main scanning direction. Incidentally, the left and right power source line pads of the driver IC 7 are connected inside the IC (not shown).

An anode wiring pad 16*a* is used for controlling the organic EL element to be driven with the driver IC 7 that controls the block on the left side, and an anode wiring pad 16*b* is used for controlling the organic EL element to be driven with the driver IC 7 that controls the block on the right side.

An anode side electrode 17*a* is prepared for the driver IC 7 to be mounted on the left side, and an anode side electrode 17*b* is prepared for the driver IC 7 to be mounted on the right side.

A data control line pad 18*a* is prepared for the driver IC to be mounted on the left side of FIG. 6, and a data control line pad 18*b* is prepared for the driver IC to be mounted on the right side of FIG. 6.

Figure 7:
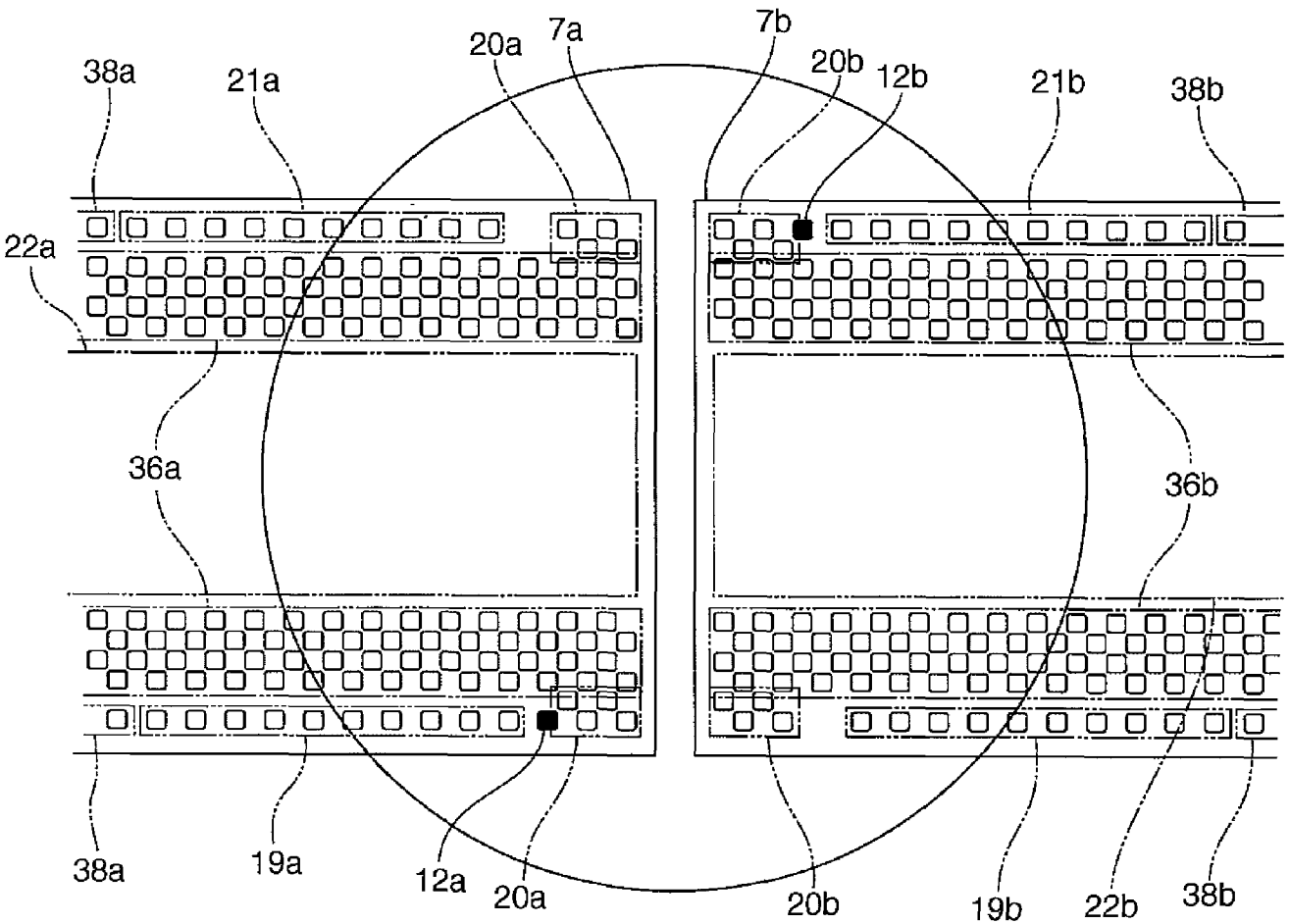
FIG. 7 is an enlarged view of section D illustrated in FIG. 3 of the organic EL array exposure head for showing the detailed configuration of adjacent driver ICs.
Figure 12:
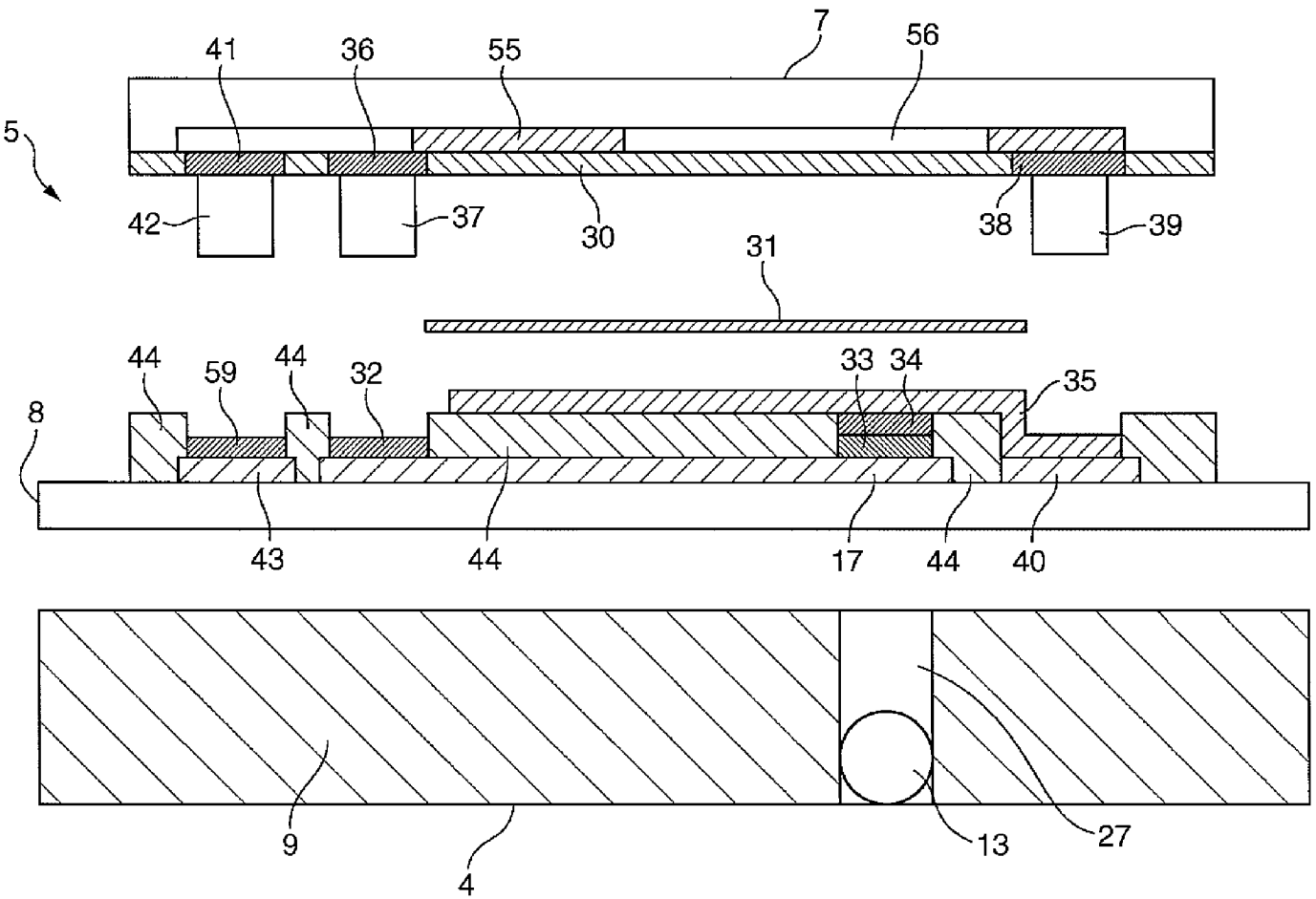
FIG. 12 is a diagram for explaining the respective constituent elements of the exposure head module.

Incidentally, the data control line 57 illustrated in FIG. 2 is connected to the data control line pad 21 of a prescribed number of driver ICs 7 in the main scanning direction (c.f. FIG. 7). And, the left and right data control line pads of the driver IC 7 are connected inside the driver IC 7, and connected to the control circuit 56 inside the circuit unit 22 of the driver IC 7 (c.f. FIG. 12).

An anode electrode pad 32*a* is prepared for the driver IC 7 to be mounted on the left side of FIG. 6, and an anode electrode pad 32*b* is prepared for the driver IC 7 to be mounted on the right side of FIG. 6. In this example, the respective anode electrode pads 32*a*, 32*b* are arranged above and below the respective anode electrodes. This is to reduce the wiring density on the glass board material and to facilitate wiring thereby.

A cathode side wiring pad 40*a* is prepared for the driver IC to be mounted on the left side of FIG. 6, and a cathode side wiring pad 40*b* is prepared for the driver IC to be mounted on the right side of FIG. 6. Incidentally, a cathode side wiring pad is constituted from a plurality of pads, excluding the data control line pad 18, of the line of the data control line pad 18.

Incidentally, the foregoing anode wiring pad 16*a*, anode wiring pad 16*b*, anode wiring pad 32*a* and anode wiring pad 32*b* correspond to the "array substrate side electrode pad" in the second embodiment of the present invention. These are provided respectively to the organic EL arrays 8 (array substrates) to come in contact with the bumps described later, and, as shown in FIG. 6, arranged in a zigzag shape along the longitudinal direction of the organic EL array 8. Further, as shown in FIG. 6, with the organic EL array 8, the respective organic EL elements are formed in an approximate central area along the longitudinal direction of the organic EL array 8, and the respective anode wiring pads (array substrate side electrode pads) are formed at the periphery of such area.

FIG. 7 is an enlarged view of section D illustrated in FIG. 3 of the organic EL array exposure head 1 for showing the detailed configuration of adjacent driver ICs 7.

A driver IC 7*a* is positioned at the left side of FIG. 7, and a driver IC 7*b* is positioned at the right side of FIG. 7.

Each positioning pad 12*a*, 12*b* represents a positioning pad on the driver IC side. The positioning pad 12*a* is used together with the positioning pad 11*a* for the positioning with the organic EL array illustrated in FIG. 6, and the positioning pad 12*b* is used together with the positioning pad 11*b* for the positioning with the organic EL array illustrated in FIG. 6.

Power source line pads 19*a*, 19*b* are the power source line pads on the driver IC side, and are bump-bonded with the power source line pads 15*a*, 15*b* on the glass board material side of FIG. 6. The power source line pad 19*a* is a pad on the driver IC side of the driver IC 7 positioned at the left side of FIG. 71 and the power source line pad 19*b* is a pad on the driver IC side of the driver IC 7 positioned at the right side of FIG. 7.

Anode wiring pads 20*a*, 20*b* are anode wiring pads at the joint of the driver ICs 7, and are bump-bonded with the anode wiring pads 16*a*, 16*b* illustrated in FIG. 6. The anode wiring pad 20*a* is for the driver IC 7 positioned at the left side of FIG. 7, and the anode wiring pad 20*b* is for the driver IC 7 positioned at the right side of FIG. 7.

Data control line pads 21*a*, 21*b* are data control line pads on the driver IC side, and are bump-bonded with the data control line pads 18*a*, 18*b* of FIG. 6. The data control line pad 21*a* is for the driver IC positioned at the left side of FIG. 7, and the data control line pad 21*b* is for the driver IC positioned at the right side of FIG. 7.

Circuit units 22*a*, 22*b* are respectively the circuit units of the driver IC 7. The circuit unit 22*a* is for the driver IC positioned at the left side of FIG. 7, and the circuit unit 22*b* is for the driver IC positioned at the right side of FIG. 7.

Anode wiring pads 36 are anode wiring pads on the driver IC side, and are bump-bonded with the anode electrode pad 32 illustrated in FIG. 6. The anode wiring pad 36*a* is for the driver IC side positioned at the left side of FIG. 7, and the anode wiring pad 36*b* is for the driver IC side positioned at the right side of FIG. 7.

Cathode wiring pads 38*a*, 38*b* are cathode wiring pads on the driver IC side, and are bump-bonded with the cathode side wiring pads 40*a*, 40*b* illustrated in FIG. 6. The cathode wiring pad 38*a* is for the driver IC side positioned at the left side of FIG. 7, and the cathode wiring pad 38*b* is for the driver IC side positioned at the right side of FIG. 7.

Incidentally, the foregoing anode wiring pad 20*a*, anode wiring pad 20*b*, anode wiring pad 36*a* and anode wiring pad 36*b* correspond to the "circuit chip side electrode pad" of the second embodiment of the present invention. These are respectively provided to each driver IC 7 (circuit chip) so as to come in contact with the bumps described later, and, as shown in FIG. 7, are arranged in a zigzag shape along the longitudinal direction of the organic EL array 8 (array substrate). Further, as shown in FIG. 7, with each driver IC 7, the circuit units 22*a*, 22*b* (drive circuits) are formed in an approximate central area along the longitudinal direction of the organic EL array 8 (array substrate), and the respective anode wiring pads (circuit ship side wiring pads) are formed at the periphery of such area.

Figure 8:
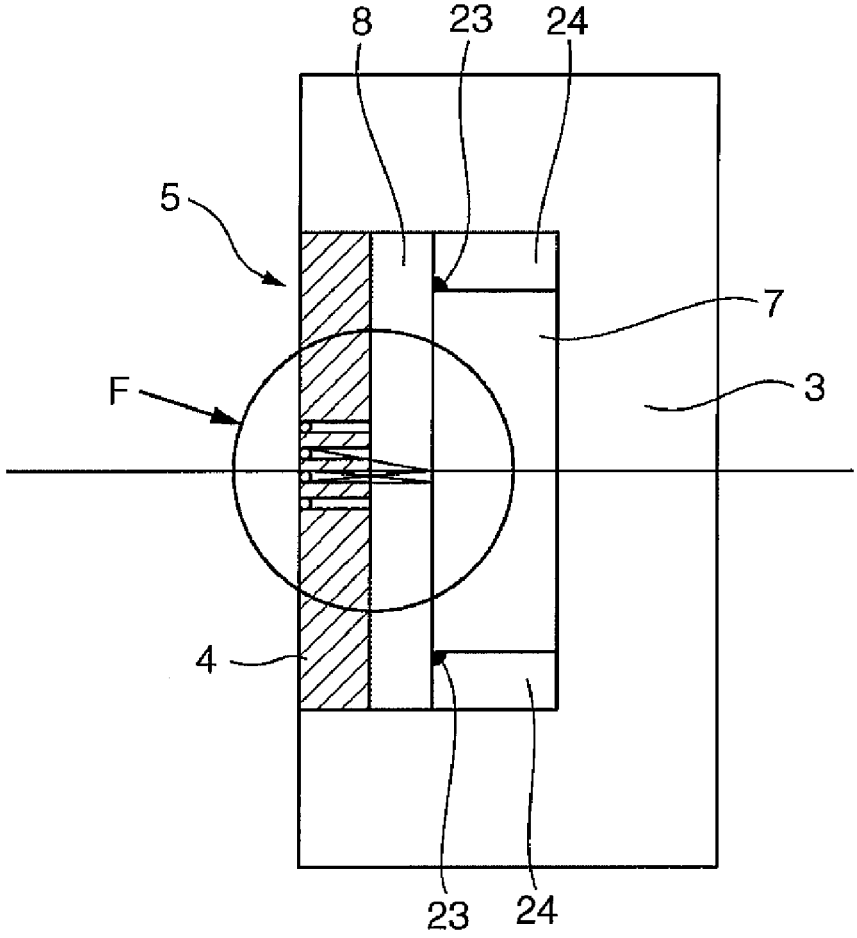
FIG. 8 is a further detailed cross sectional view of the organic EL array exposure head, and shows the cross section in the direction of line B-B illustrated in FIG. 1.

FIG. 8 is a further detailed cross sectional view of the organic EL array exposure head 1, and shows the cross section in the direction of line B-B illustrated in FIG. 1. As shown in FIG. 8, the organic EL array exposure head 1 has an exposure head module 5 and a frame (head support frame) 3. Here, the exposure head module 5 is complex formed from a condenser lens array 4, organic EL array 8 and driver IC 7, and is fixed to the frame 3 with a sealant 24. Further, the frame 3 is used as a radiator of the driver IC 7. Reference numeral 4 represents a condenser lens array, reference numeral 8 represents an organic EL array, and reference numeral 23 represents a sealant, respectively.

Figure 9:
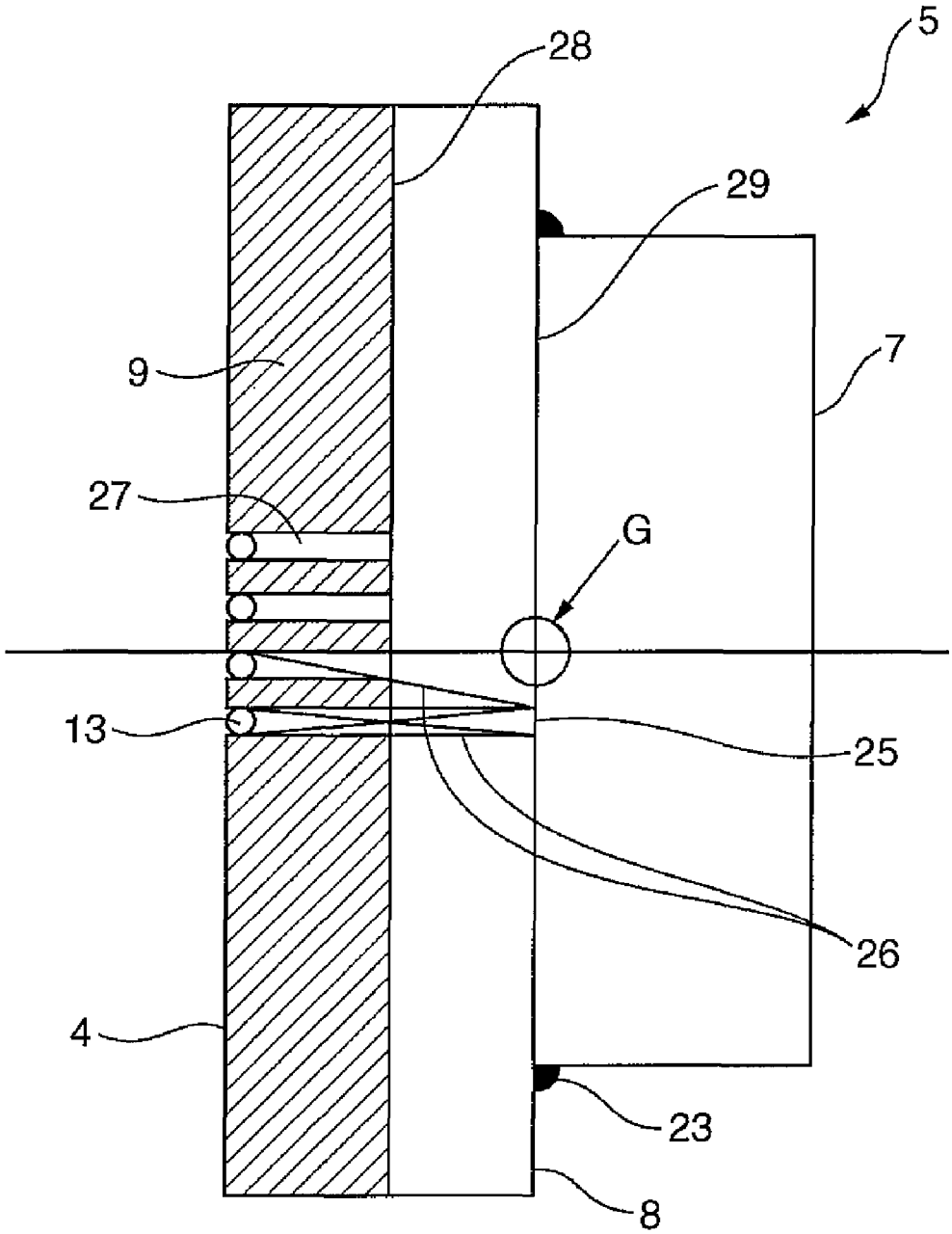
FIG. 9 is an enlarged cross sectional view of section F shown in FIG. 8 of the organic EL array exposure head, and is a diagram showing an exposure head module.

FIG. 9 is an enlarged cross sectional view of section F shown in FIG. 8 of the organic EL array exposure head 1, and is a diagram showing the exposure head module 5. The light emitted from the light emitting unit 25 formed on the organic EL array 8 passes through the optical path 26 and arrives at the light guiding hole 27. Among these lights, the light passing through the light guiding hole 27 immediately above the light emitting unit 25 passes through the condenser lens 13, becomes an approximate parallel beam and connects with the photoreceptor (not shown). Nevertheless, light that reaches the light guiding hole 27 that is not immediately above the light emitting unit 25 is shielded by the light shielding unit 9, and will not reach the condenser lens 13 arranged therein. Incidentally, reference numeral 4 represents a condenser lens array, reference numeral 7 represents a driver IC, reference numeral 8 represents an organic EL array, reference numeral 23 represents a sealant, reference numeral 28 represents an adhesive, and reference numeral 29 represents a bump-bonded part, respectively.

Figure 10:
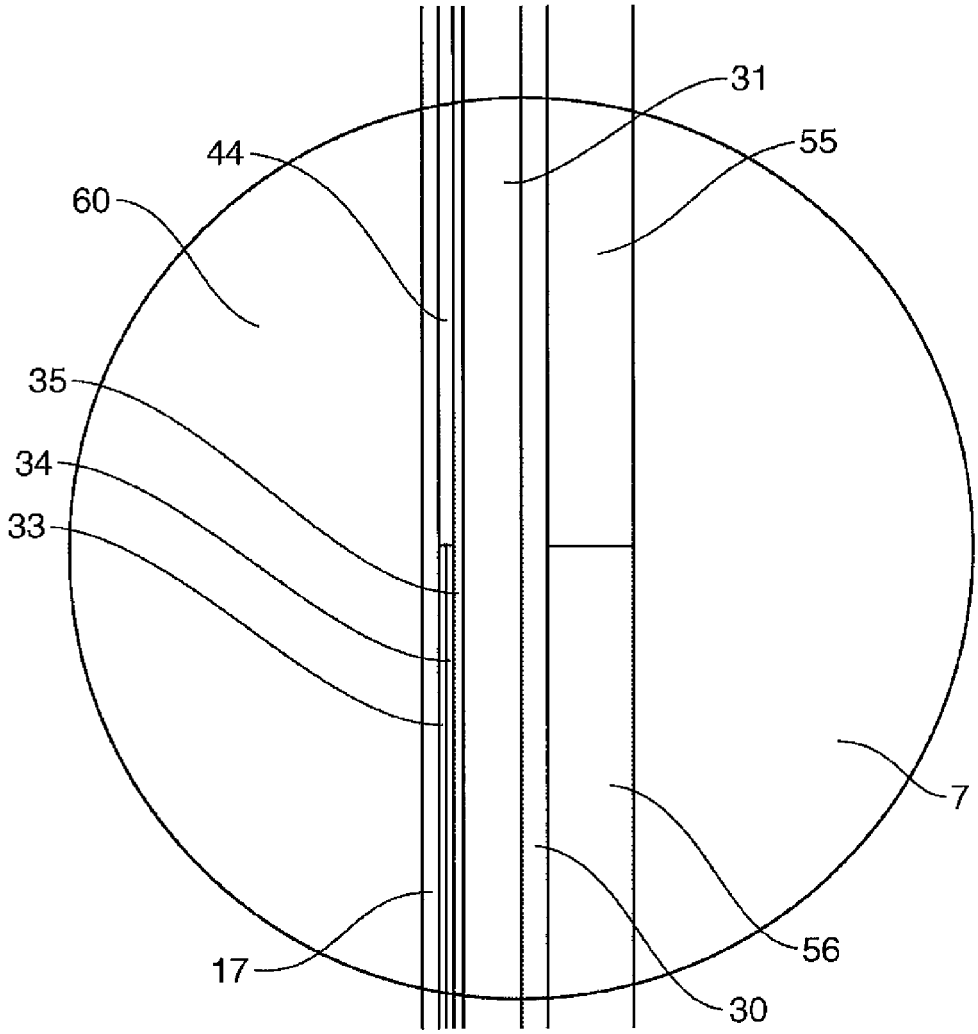
FIG. 10 is an enlarged view of section G shown in FIG. 9 of the exposure head module, and is for explaining the lamination of the light emitting unit periphery and driver IC of the organic EL array.

FIG. 10 is an enlarged view of section G shown in FIG. 9 of the exposure head module 1, and is for explaining the lamination of the light emitting unit 25 periphery and driver IC of the organic EL array 8. A drive circuit 55 and a control circuit 56 are arranged on the substrate of the driver IC 7, and the surface thereof is covered with an insulating layer 30. A moisture absorbent 31 is arranged in the gap between the driver IC 7 and organic EL array 8. The cathode electrode 35 is a constituent element of the organic EL element, and a emission layer 34, a hole transport layer 33 and an anode electrode 17 are laminated thereon. The insulating layer 44 is arranged at the periphery of the light emitting unit 25. The glass board material 60 is used for supporting the organic EL light emitting element, and also functions as a sealant for protecting this element from the outside world. Incidentally, in this example, on the opposite side, one face of the driver IC 7 also functions as a sealant.

Figure 11:
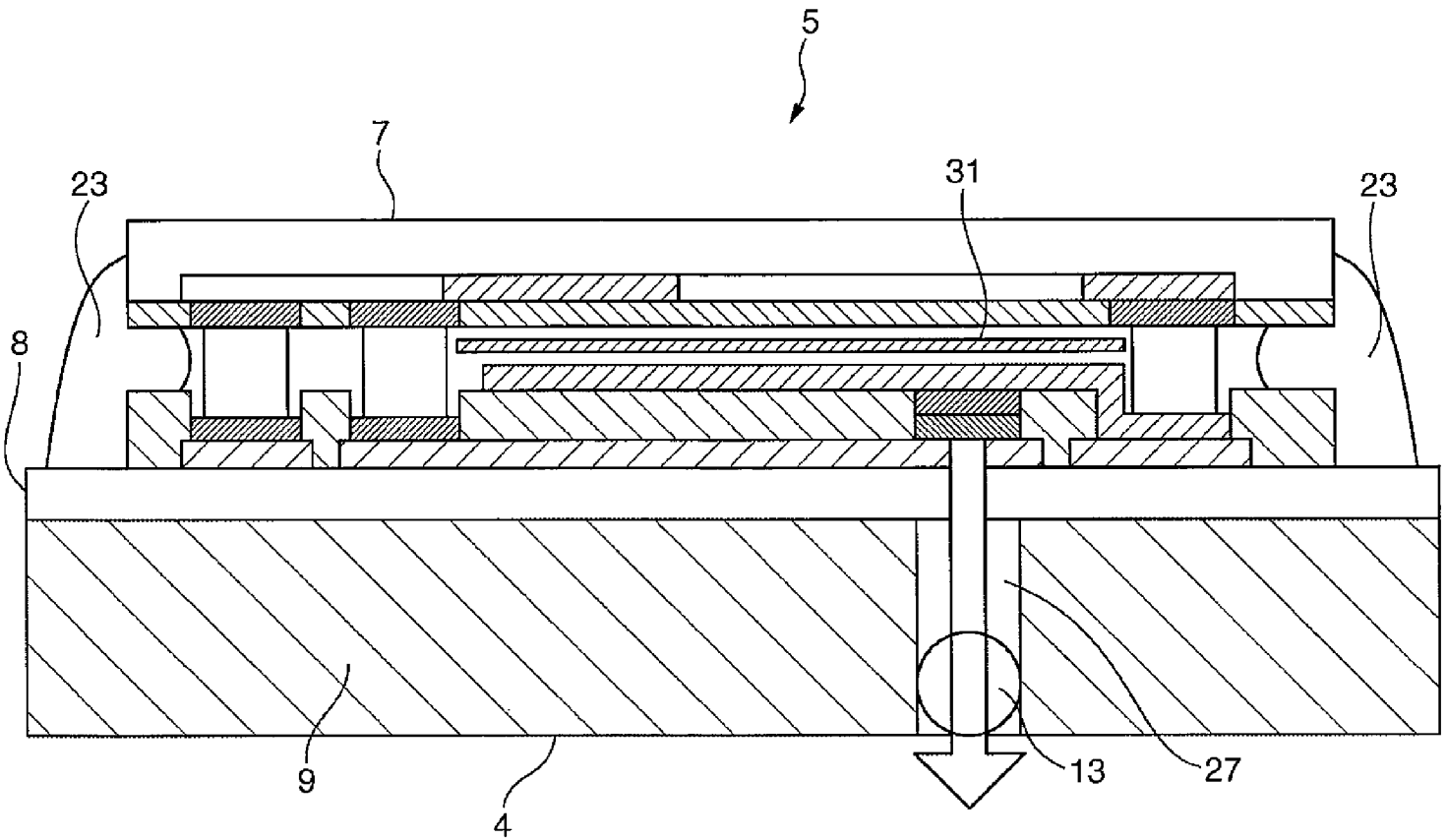
FIG. 11 is a diagram for explaining the configuration of the exposure head module.

FIG. 11 is a diagram for explaining the configuration of the exposure head module 5, and FIG. 12 is a diagram for explaining the respective constituent elements of the exposure head module 5. Incidentally, FIG. 11 and FIG. 12 show a part of the light emitting unit and the like (emission layer 34, condenser lens 13 and so on illustrated in the diagrams) in order to facilitate the understanding of this explanation, and the other parts of the light emitting unit and the like are omitted.

Figure 13A:
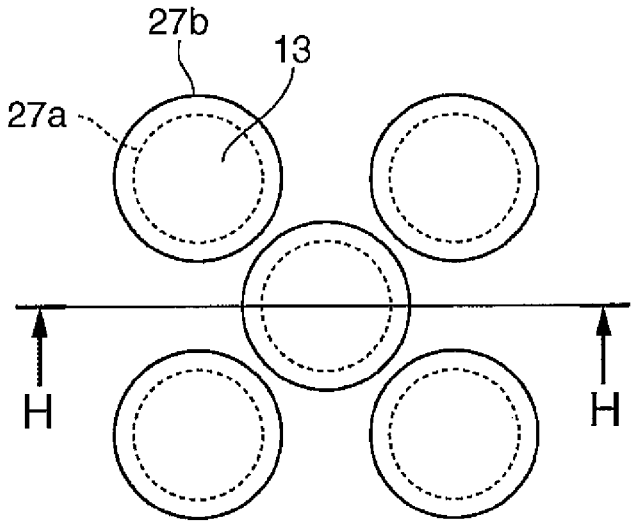
FIG. 13(A) and FIG. 13(B) are diagrams for explaining the configuration of the condenser lens array.
Figure 13B:
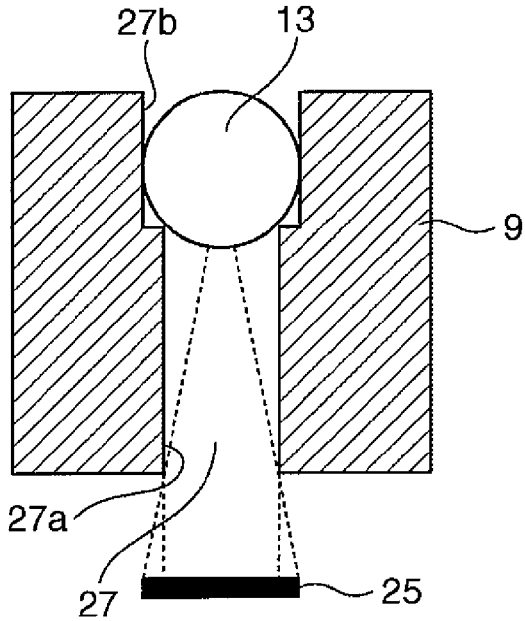

The exposure head module 5 is configured from a driver IC 7, a moisture absorbent 31, an organic EL array 8 and a condenser lens array 4. FIG. 13 is a diagram for explaining the configuration of the condenser lens array 4, wherein FIG. 13(A) is a diagram showing the relationship of the respective light guiding holes 27, and FIG. 13(B) is a cross section of line H-H illustrated in FIG. 13(A).

A plurality of through holes having the same pattern as the arrangement pattern of the respective light emitting units 25 formed on the organic EL array 8 are formed on the surface of the condenser lens array 4. As shown in FIG. 13, the diameter of the through hole (light guiding hole 27*a* on the light emitting unit side) on the side to be adhered to the condenser lens array 4; that is, the incident side of light is set to be larger than the diameter of the through hole (light guiding hole 27*b* on the lens press-fitting side) on the output side of light.

Further, a condenser lens 13 is press fitted to the through hole (light guiding hole 27*b* on the lens press-fitting side) on the output side of light. Meanwhile, the light shielding material 9 constituting the condenser lens array 4 is configured from the likes of fiber reinforced plastic (FRP) having roughly the same characteristics as the thermal expansion of the condenser lens 13, and the diameter of the light guiding hole 27*b* on the lens press fitting side is set to be slightly smaller than the diameter of the condenser lens 13 to an extent that enables the retention of the condenser lens 13. Incidentally, the light guiding hole 27 is designed to only output the light from the light emitting unit 25 immediately therebelow via the condenser lens, and to shield the light from adjacent light emitting units to prevent such light from passing therethrough. According to the condenser lens array 4 having the foregoing configuration, since the diameter of the condenser lens 13 can be enlarged, it is able to condense more light emitted from the light emitting units, and the amount of light to be output can be increased as a result thereof. Further, when the diameter of the condenser lens 13 is enlarged, since the spherical aberration of such lens can be curtailed, this point in itself is advantageous. Moreover, when a drum-shaped lens is used as the condenser lens 13, the spherical aberration can be curtailed even further.

FIG. 14 is a diagram for explaining the manufacturing process of the organic EL array 8 illustrated in FIG. 12. Incidentally, similar to FIG. 12, FIG. 14 shows a part of the light emitting unit and the like (emission layer 34 and so on illustrated in the diagram) in order to facilitate the understanding of this explanation, and the other parts of the light emitting unit and the like are omitted.

The organic EL array 8 is manufactured through the respective processes depicted in FIG. 14(A), FIG. 14(B), FIG. 14(C) and FIG. 14(D). To describe this in detail, foremost, with the process shown in FIG. 14(A), a glass board material side wiring electrode pad 43, an anode electrode transparent electrode 17 and a cathode side wiring electrode pad 40, which are transparent electrode (ITO) films, are formed on a glass board material 60. These, for example, are foremost deposited via sputtering or the like, and thereafter patterned with the photolithography technique and etching technique. In the present embodiment, the anode electrode 17, cathode side wiring electrode pad 40 and glass substrate side wiring electrode pad 43 or formed from a transparent electrode (ITO) film, which is an example of a first conductive material. The cathode side wiring electrode pad 40 and glass substrate side wiring electrode pad 43 are provided at the periphery of an area to which the anode electrode 17 is provided on the glass board material 60.

Figures 14A, 14B, 14C, 14D:
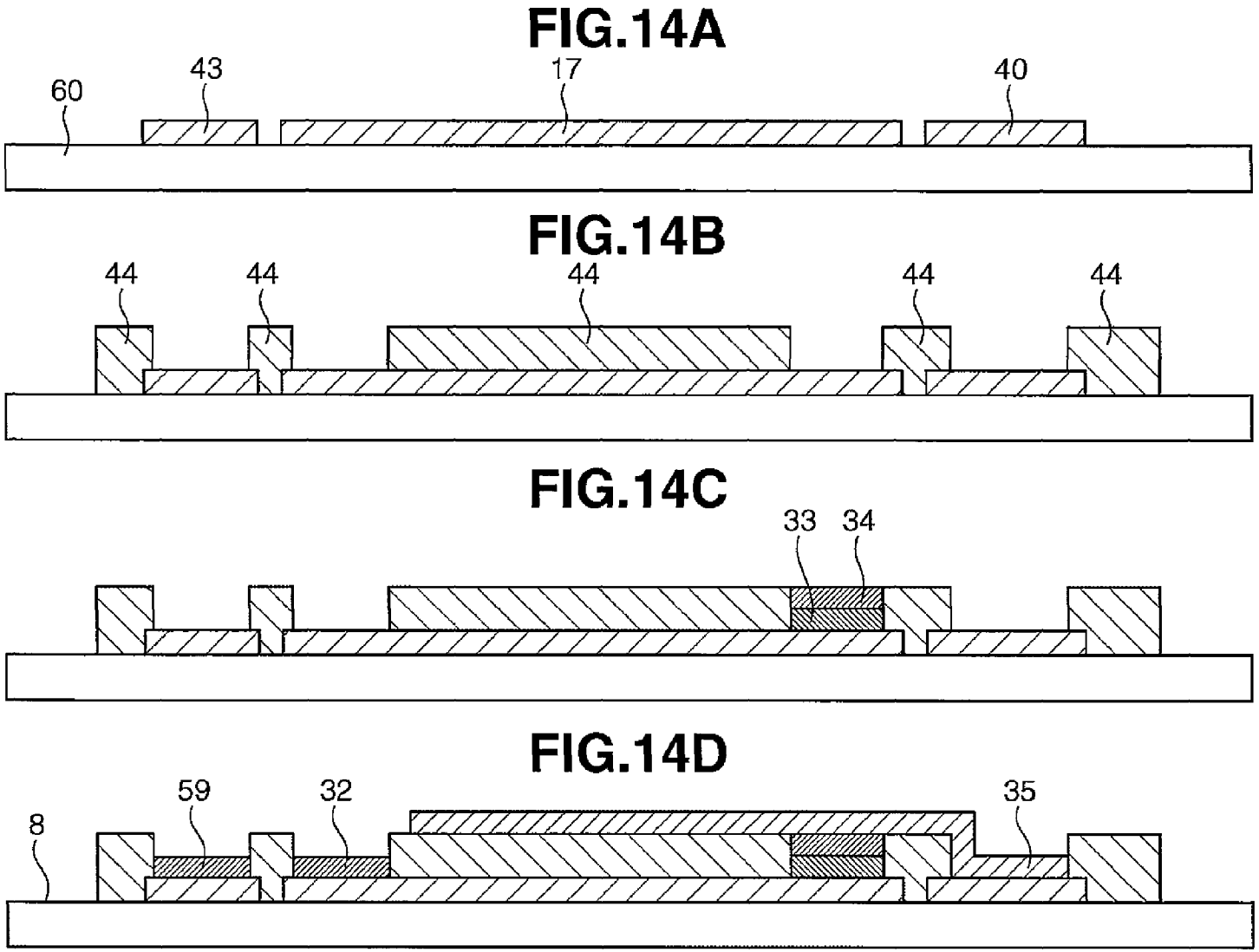
FIG. 14(A) to FIG. 14(D) are diagrams for explaining the manufacturing process of the organic EL array illustrated in FIG. 12.

With the process shown in FIG. 14(B), an insulating layer (polyamide or the like) 44 is formed on the glass board material 60 to which the ITO has been patterned. Further, with the process shown in FIG. 14(C), an organic EL emission layer formed from a high-polymeric material or low-molecular material is formed. This organic EL emission layer is configured by including a emission layer 34, a hole transport layer 33, or in addition thereto an electron transport layer (not shown) or the like, and each layer is formed with respectively suitable materials.

Finally, with the process shown in FIG. 14(D), a cathode electrode 35 using a material such as aluminum (Al), which is an example of a second conductive material, as well as an anode electrode aluminum pad 32, which is an example of a second electrode, and an electrode pad 59 are formed via vapor deposition or the like. The cathode electrode 35 is formed so as to be arranged facing a plurality of anode electrodes 17 with the organic EL emission layer placed therebetween. Further, the cathode electrode 35 is formed so as to be connected to the organic EL emission layer and the cathode side wiring electrode pad 40. Specifically, the cathode electrode 35 is formed sequentially so as to cover at least a part is of the insulating layer 44, emission layer 34 and cathode side wiring electrode pad 40. In other words, the cathode electrode side wiring electrode pad 40 is provided between the glass substrate 60 and cathode electrode 35 at the periphery of the area to where the anode electrode 17 and the organic EL emission layer are provided.

Further, the cathode electrode 35 is formed so as to cover a plurality of organic EL emission layers. In other words, the cathode electrode 35 is shared by a plurality of organic EL emission layers. The anode electrode aluminum pad 32 and electrode pad 59 are respectively provided on the glass substrate side wiring electrode pad 43 and anode electrode 17.

The organic EL array 8 formed as described above is fixed to the condenser lens array 4 via an adhesive such as thermosetting resin (c.f. FIG. 12). Upon such fixation, the positioning pad 10 provided to the condenser lens array 4 and the positioning pad 11 provided to the organic EL array 8 are used (c.f. FIG. 5 and FIG. 6), and high precision of absolute location can be secured thereby.

Next, the organic EL array 8 and driver IC 7 are bonded with bumps 42, 37, 39, and fixed (c.f. FIG. 12). Upon such fixation, the positioning pad 10 provided to the condenser lens array 4 and the positioning pad 12 provided to the driver IC 7 are used (c.f. FIG. 6 and FIG. 7), and high precision of absolute location can be secured thereby. Incidentally, during bump bonding, a moisture absorbent 31 is inserted between the driver IC 7 and organic EL array 8 (c.f. FIG. 12). This moisture absorbent 31 is for protecting the hole transport layer 33 and emission layer 34 from humidity to avoid deterioration, and desiccate or the like is used.

Here, to describe the driver IC 7 (c.f. FIG. 12) in detail, foremost, the drive circuit 55 and control circuit 56 constitute the circuit unit 22 of the driver IC illustrated in FIG. 7. The drive circuit 55 and control circuit 56 are disposed away from the location where the bump pads are disposed in order to avoid the destruction of elements caused by the pressure during bump bonding.

The wiring electrode pad 41 configures the power source line pad 19 and data control line pad 21 illustrated in FIG. 7. A wiring electrode bump 42 is formed on this wiring electrode pad 41. The wiring electrode bump 42 is formed with an electrical conducting material (gold or the like) for being connected and fixed to the electrode aluminum pad 59 of the organic EL array 8.

The anode wiring pad 36 configures the anode wiring pad 20 and anode wiring pad 36 at the joint of the driver IC illustrated in FIG. 7. An anode wiring bump 37 is formed on this anode wiring pad 36. The anode wiring pad 36 is formed with an electrical conducting material (gold or the like) for being connected and fixed to the electrode aluminum pad 32 of the organic EL array 8.

The cathode wiring pad 38 is configuring the cathode wiring pad 38 illustrated in FIG. 7. A cathode wiring bump 39 is formed on this cathode wiring pad 38. The cathode wiring pad 38 is formed with an electrical conducting material (gold or the like) for being connected and fixed to the electrode aluminum pad 35 of the organic EL array 8. Thereby, the anode electrode 17 and cathode electrode 35 are connected to the driver IC via the bumps 37 and 39, respectively.

Promptly after bonding the organic EL array 8 having the foregoing configuration and the driver IC 7 with the bumps 42, 37, 39, the periphery of the bonded part of the organic EL array 8 and the driver IC 7 is fixed with a sealant 23. As a result of forming the exposure head module 5 as described above, the light output from the emission layer 34 will pass through the light guiding hole 27 immediately therebelow and become an approximate parallel beam at the condenser lens 13, and form an image on the surface of the photoreceptor not shown.

Next, the control technique of emission is explained in detail.

Figure 15:
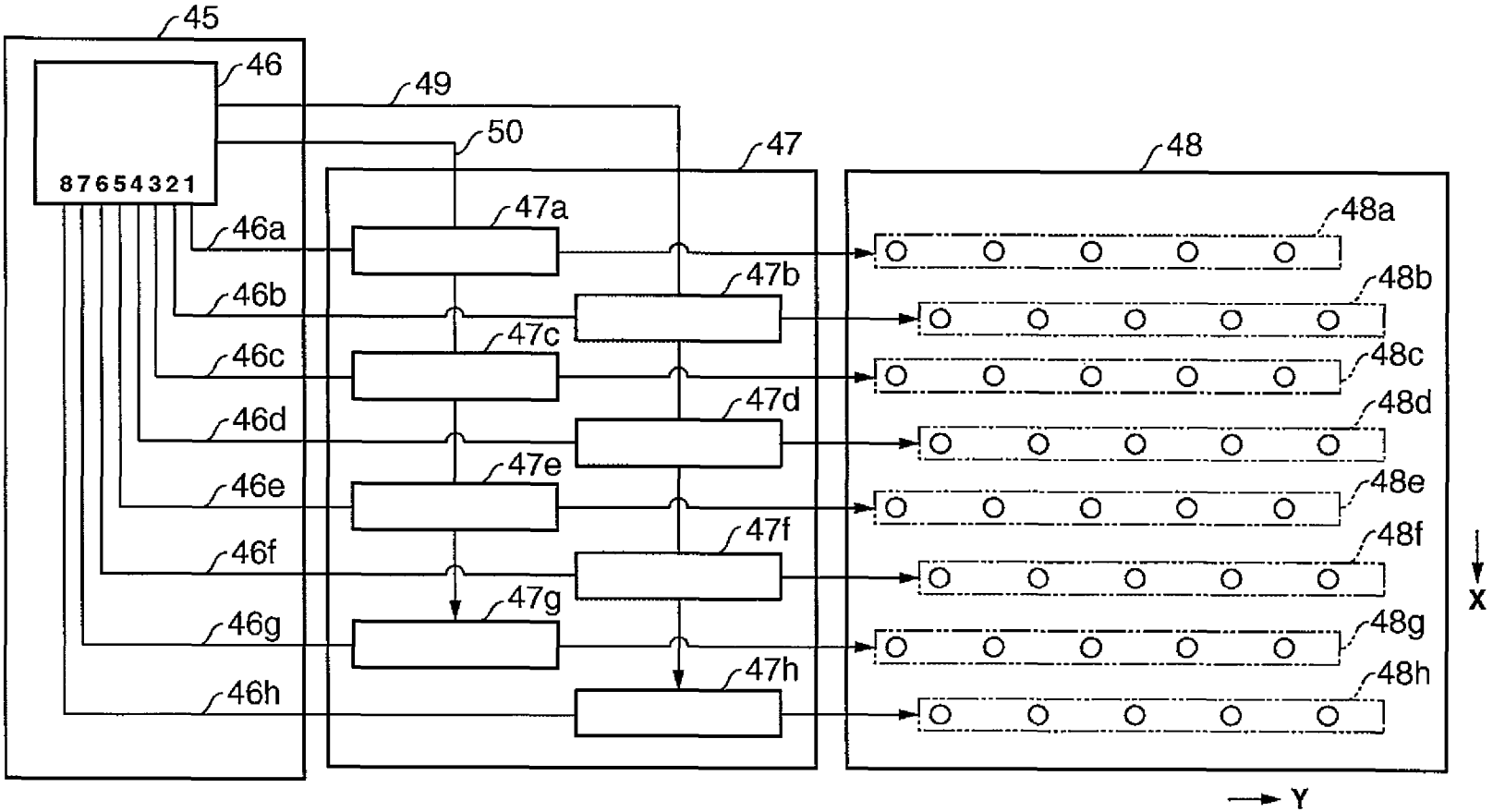
FIG. 15 is a diagram showing the configuration of a light emitting element control circuit.

FIG. 15 is a diagram showing the configuration of a light emitting element control circuit according to the present embodiment. Incidentally, although explained below is an example taking the control technique of the light emitting unit 25 controlled by a single driver IC 7, this technique is is merely an exemplification, and the method of controlling the light emitting unit 25 may be changed arbitrarily.

A plurality of light emitting units 25 formed on the organic EL array 8 are aligned in the main scanning direction Y as illustrated with reference numeral 48 in FIG. 15, and aligned in a zigzag shape in eight rows in the vertical scanning direction X. The data processing unit 45 is realized with a printer controller (not shown), performs the processing of color separation, gradation processing, bitmap development of image data and color drift adjustment based on the image data to be formed on the one hand, and outputs the image per line to the storage unit 47 on the other hand. The data processing unit 45 may be realized with a printer controller, or this may also be realized with the circuit unit 22 of the driver IC 7.

The storage unit 47 is configured from shift registers 47*a* to 47*h*. These shift registers are classified into shift registers 47*a*, 47*c*, 47*e*, 47*g* belonging to a first group, and shift registers 47*b*, 47*d*, 47*f*, 47*h* belonging to a second group. The shift registers 47*a*, 47*c*, 47*e*, 47*g* belonging to the first group perform the retention of image data, output to the light emitting unit, and transfer to the subsequent level shift registers.

The shift registers 47*b*, 47*d*, 47*f*, 47*h* belonging to the second group, as with the shift registers belonging to the first group, perform the retention of image data, output to the light emitting unit, and transfer to the subsequent level shift registers. The lines of the light emitting unit, as with the shift registers, are also classified into lines 48*a*, 48*c*, 48*e*, 48*g* of the light emitting unit belonging to a first group, and lines 48*b*, 48*d*, 48*f*, 48*h* of the light emitting unit belonging to a second group. Incidentally, although a shift register group for transferring one line worth of image data in the main scanning direction Y is provided to the storage unit 47, this is omitted in FIG. 15 to prevent the diagram from becoming complicated. Further, the storage unit 47 may also be realized with the circuit unit 22 of the driver IC 7 as with the foregoing data processing unit 45.

To explain the operation of the light emitting element control circuit, foremost, from the data output timing control unit 46 contained in the data processing unit 45, image data is output from the control line 50 to the shift registers of the first group, and image data is output from the control line 49 to the shift registers of the second group.

The image data stored in the respective shift registers is output to the corresponding light emitting unit according to the timing signals 46*a* to 46*h* supplied from the data output timing control unit 46 to the respective shift registers.

Specifically, foremost, when the timing signal 46*a* is supplied from the data output timing control unit 46 to the shift registers 47*a*, image data is output from the shift register 47*a* to the top line 48*a* of the light emitting unit of the first group, and exposure of the first pixel line is performed at the spot position on the photoreceptor (not shown). Similarly, when the timing signal 46*b* is supplied from the data output timing control unit 46 to the shift registers 47*b*, image data is output from the shift register 47*b* to the top line 48*b* of the light emitting unit of the first group, and exposure of the second pixel line is performed at the spot position on the photoreceptor (not shown).

Next, when the image carrier moves in a distance of the pixel pitch in the vertical scanning direction, the image data stored in the shift register 47*a* is transferred to the shift register 47*c*. Similarly, the image data stored in the shift register 47*b* is transferred to the shift register 47*d*. And, when the timing signal 46*c* and timing signal 46*d* are supplied from the data output timing control unit 46 to the shift register 47*c* and shift register 47*d*, image data is output from the shift register 47*c* and shift register 47*d* to the light emitting unit lines 48*c* and 48*d*, respectively. Thereupon, exposure of the same pixel is performed on the first pixel line and second pixel line of the spot position. Subsequently, similar to the above, movement of the image carrier and transfer of the image data to the respective shift registers as well as the output of image data to the light emitting unit are performed, and multi-exposure is performed to the same pixel.

As described above, even when the light emitting unit is aligned in a zigzag shape, and the spacing in the vertical scanning direction of the spot position formed on the image carrier by the light emitting unit is made to be an integral multiple of the pixel density in the vertical scanning direction, multi-exposure can be performed to a single pixel. In other words, even when the light emitting unit is aligned in a zigzag shape, the storage unit and light emitting unit row of the respective pixel rows can be made to correspond one-on-one. Thus, the simplification of the circuit configuration and the speed-up of operation can be sought by matching the timing of transferring the image data stored in the shift registers to the subsequent level shift registers, and the timing of emitting the light emitting unit line based on the image data of the pixel row stored in the shift registers.

Further, in the case of aligning the light emitting unit in a zigzag shape, with the light emitting unit line 48, each line can be sequentially emitted in a one-dot line pitch spacing in the order of 48*a*→48*b*→48*c*→48*d*→48*e*→48*f*→48*g*→48*h*.

Incidentally, by using four exposure head described above, it goes without saying that this may be applied to a so-called tandem system image formation device which performs image formation with the four colors of cyan (C), magenta (M), yellow (Y) and black (K).

Figure 16:
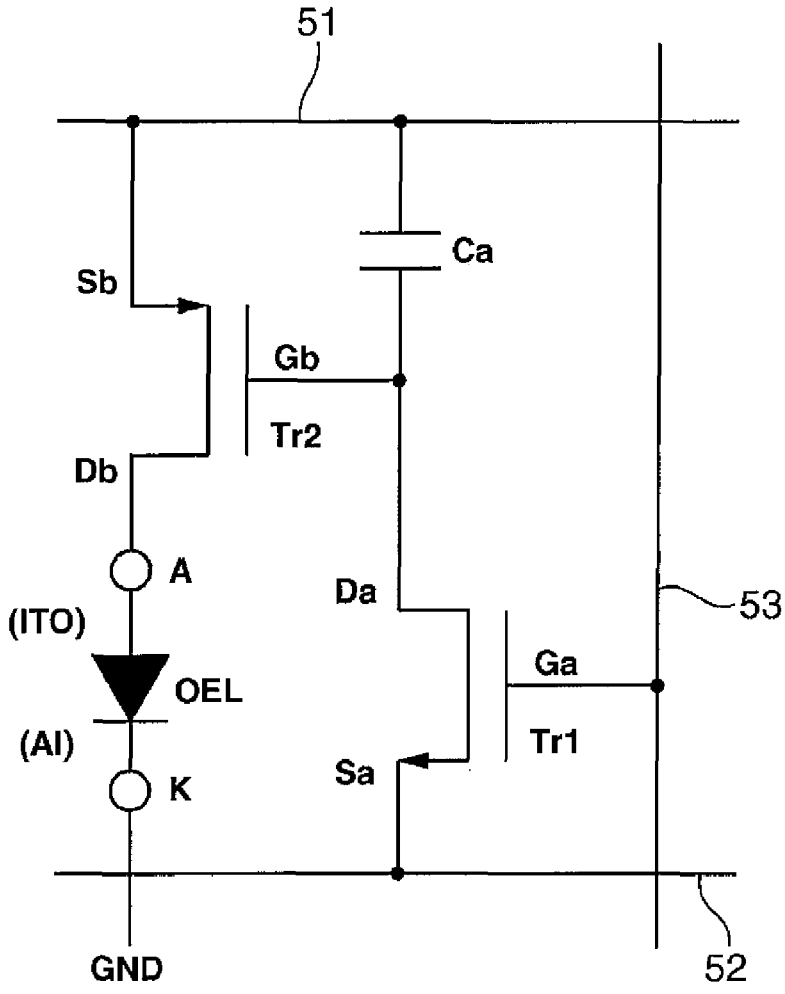
FIG. 16 is a diagram showing the configuration of a drive circuit for driving the light emitting unit via an active matrix.
Figure 17:
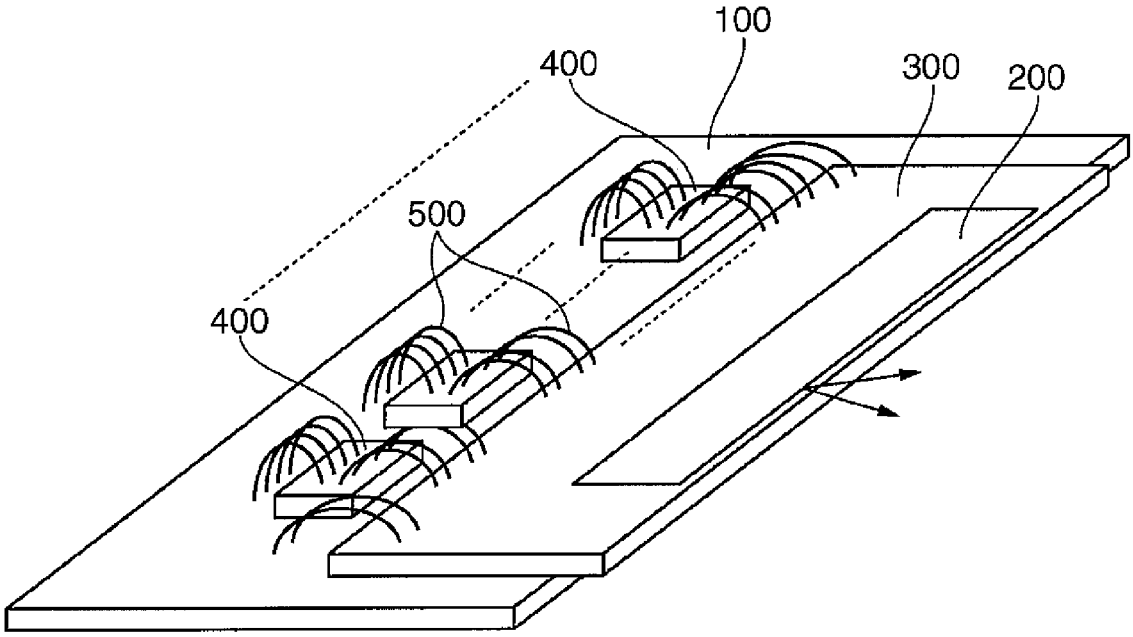
FIG. 17 is a diagram exemplifying the configuration of an organic EL array print head adopting an organic EL as the light source.

FIG. 16 is a diagram showing the configuration of a drive circuit for driving the light emitting unit via an active matrix. The power supply line 51 is connected to a source Sb of a driving transistor Tr2. Meanwhile, an anode terminal A of the organic EL element configuring the light emitting unit is connected to a drain Db of a driving transistor Tr2, and a cathode terminal K is connected to a ground GND. Further, a scan line 53 is connected to a gate Ga of a switching transistor Tr1, and a capacity line 52 is connected to a source Sa of a switching transistor Tr1. Further, the drain Da of the switching transistor Tr1 is connected to the gate Gb of the driving transistor Tr2 and one of the electrodes of the storage capacitor Ca. The source Sb of the driving transistor Tr2 is connected to the other electrode of this storage capacitor Ca.

To explain the operation of the drive circuit, foremost, when the scan line 53 is energized in a state where the voltage of the power supply line 51 is applied to the drain Da of the switching transistor Tr1 via the storage capacitor Ca, the switching transistor Tr1 will be switched from OFF to ON. According to this switching operation, the gate voltage of the driving transistor Tr2 will fall, and the driving transistor Tr2 will be switched from OFF to ON. As a result, the organic EL element will operate and emit a prescribed amount of light, and the storage capacitor Ca will be recharged due to the potential difference between the power supply line 51 and capacity line 52.

Thereafter, even if the switching transistor Tr1 is switched from ON to OFF, since the driving transistor Tr2 will maintain its ON state based on the electrical charge recharged in the storage capacitor Ca, the organic EL element will maintain its emitting state. As a result, even when the switching transistor Tr1 is switched from ON to OFF due to the image data being transferred to the shift registers, the organic EL element will continue to maintain its emitting operation, and exposure of high-intensity pixels will be enabled.

As described above, according to the exposure head of the present embodiment, the respective organic EL elements and the driver IC (circuit chip) can be electrically connected without having to use wire bonding, and the mounting area can be curtailed thereby. In particular, by arranging the respective anode wiring pads (array substrate side electrode pad, circuit chip side electrode pad) in a zigzag shape, for instance, since the mounting area can be curtailed in comparison to the case of arranging [respective electrode pads] at even intervals in a two-dimensional array, the width of the overall exposure head (length of the direction orthogonal to the longitudinal direction) can be reduced.

Further, as a result of adopting the configuration of arranging the organic EL array (array substrate) and the respective driver ICs (circuit chips) such that the respective driver ICs face immediately above the is organic EL element, it will be possible to avoid inconveniences such as damages to the drive circuit and/or organic EL element resulting from the stress caused by the suppressing strength upon bump-bonding the array substrate and circuit chip.

Moreover, according to the exposure head of the present embodiment, by using the organic EL array substrate as one sealing means on the side of the light emitting unit, and using the driver IC as the other sealing means, miniaturization is realized with high density mounting, and the mounting area can be reduced thereby. Further, since it is not necessary to provide a sealant separately, the number of components can be reduced, and an exposure head can be manufactured at a low cost.

The working examples and practical examples explained with the embodiments of the present invention may be used in arbitrary combination according to the usage, or may be used upon modification or improvement, and the present invention shall not be limited to the description of the foregoing embodiments. It is evident from the claims that such combination, modification or improvement is included in the technical scope of the present invention.

We claim:

1. An exposure head, comprising:

a glass substrate;

a plurality of anode electrodes provided to one face of said glass substrate and formed from a first conductive material;

a cathode electrode arranged facing said plurality of anode electrodes and formed from a second conductive material;

a first electrode formed from said first conductive material and provided between glass substrate and said cathode electrode at the periphery of said plurality of anode electrodes;

a plurality of organic EL emission layers respectively provided between said plurality of anode electrodes and said cathode electrode; and a driver IC having a plurality of drive electrodes arranged facing said one face, and for controlling the emission of said plurality of organic EL emission layers;

wherein said cathode electrode is connected to said plurality of organic EL emission layers and said first electrode, and further connected to a drive electrode of said driver IC via a conductive member at said periphery.

2. The exposure head according to claim 1, further comprising a second electrode formed from said second conductive material, and provided on said anode electrode at the periphery of said cathode electrode;

wherein said anode electrode is connected to a drive electrode of said driver IC via said second electrode and a conductive member.

3. The exposure head according to claim 1 or claim 2, wherein the adhesiveness against said glass substrate of said first conductive material is greater than that of said second conductive material.

* * * * *